US005394775A

United States Patent [19]

Fagerstrom

[11] Patent Number: 5,394,775

[45] Date of Patent: Mar. 7, 1995

[54] MUSICAL DRUM PRECISION TUNING TOOL

[76] Inventor: Jon E. Fagerstrom, 102 Three Meadows Ct., Perrysburg, Ohio 43551

[21] Appl. No.: 194,399

[22] Filed: Feb. 10, 1994

[51] Int. Cl.[6] ..... B25B 23/144

[52] U.S. Cl. ..... 81/479; 81/483

[58] Field of Search ..... 81/478, 479, 483

[56] References Cited

U.S. PATENT DOCUMENTS

| | | | |
|---|---|---|---|
| 2,537,997 | 1/1951 | Hattan | 81/52.5 |
| 4,126,062 | 11/1978 | Solomon | 81/483 |
| 4,403,530 | 9/1983 | Biddle | 81/478 |
| 4,561,332 | 12/1985 | Wood | 81/479 |
| 4,732,062 | 3/1988 | Grabovac et al. | 81/478 X |
| 5,129,293 | 7/1992 | Larson et al. | 81/478 X |
| 5,152,200 | 10/1992 | Kaplan | 81/478 |

*Primary Examiner*—James G. Smith
*Attorney, Agent, or Firm*—John R. Flanagan

[57] ABSTRACT

A precision tuning tool for use in tuning a tunable lug rotatably mounted on a musical drum includes an elongated handle, a torque applying mechanism engageable with the lug for applying torque to the lug so as to tune the lug by pivoting the elongated handle relative thereto, a torque calibrating mechanism mounted to the elongated handle for defining a desired preset amount of torque to be applied to the lug by the torque applying mechanism, a preset torque indicating mechanism mounted to the elongated handle and mounting and supporting the torque applying mechanism adjacent to one end of the elongated handle and, in response to application of torque to the lug by the torque applying mechanism, being operable for producing an indication when the desired preset amount of torque has been applied to the lug, and a biasing mechanism mounted to the elongated tubular member and to the torque calibrating mechanism for applying a desired level of biasing force to the preset torque indicating mechanism in response to the desired preset amount of torque defined by the torque calibrating mechanism to thereby preset the amount of torque that can be applied to the lug before the indication is produced by the preset torque indicating mechanism.

8 Claims, 2 Drawing Sheets

MUSICAL DRUM PRECISION TUNING TOOL

BACKGROUND OF THE INVENTION

1. Field of the Invention

The present invention generally relates to devices for tuning musical instruments and, more particularly, is concerned with a precision tuning tool for tuning a musical drum.

2. Description of the Prior Art

Tunable drums are used by percussionists playing in a wide array of musical bodies, ranging from orchestras to bands and from combos to drum and bugle corps. Such drums employ a plurality of tunable square-headed lugs peripherally spaced about the drum head. In tuning the drum, the objective is to adjust the lugs so that they apply a uniform level of force about the periphery of the drum head. The currently accepted method of tuning a drum is to employ a drum "key" to manually tighten the drum lugs. This method is not only time-consuming but must rely solely on the skill and training of the person doing the tuning to sense when the same amount of torque has been applied to each lug. However, all but the most highly skilled persons are incapable of achieving the above-described objective whereby the level of tuning which results will still be imprecise and lacking in uniformity.

Such tuning imprecision and lack of uniformity has deleterious effects on the performance life of the drum. The lack of uniformity means that the loosest lug will vibrate loose after a relatively short period of time, changing the pitch and altering the sweet spot of the drum playing surface. The lack of uniformity creates weak spots in the playing surface which often result in damage to the drum head and necessitates frequent replacement. Also, the drum head is subjected to increased levels of wear and of percussive strike stresses which tend to shorten the performance life of the drum.

Consequently, a need exists for a precision tuning tool which will eliminate the deleterious effects of the prior art method of tuning a drum.

SUMMARY OF THE INVENTION

The present invention provides a precision tuning tool designed to satisfy the aforementioned need. The precision tuning tool of the present invention allows percussionists, technicians and instructors to more easily and rapidly, more uniformly and, above all, more accurately tune drums which are equipped with standard tunable square lugs. Due to enhanced head uniformity, weak spots are eliminated and wear and percussive strike stresses are greatly reduced, thereby extending the performance life of the drum.

The precision tuning tool of the present invention permits all lugs of the drum to be tuned with equal force. Thus, they will remain in tune for a much greater period of time. Different levels of intonation, heretofore unattainable, are now easily selectable with the precision tuning tool of the present invention.

Accordingly, the present invention is directed to a precision tuning tool for tuning a tunable lug rotatably mounted on a musical drum. The precision tuning tool comprises: (a) a tubular handle having a central longitudinal axis; (b) a torque applying mechanism engagable with the tunable lug and being operable to apply torque to the lug so as to tune the lug by pivoting the handle relative thereto; (c) a torque calibrating mechanism mounted to the handle and being operable to define a desired preset amount of torque to be applied to the lug by the torque applying mechanism; (d) a preset torque indicating mechanism mounted to the handle and extending along the longitudinal axis thereof and supporting the torque applying mechanism adjacent to one end of the handle and, in response to the application of torque to the lug by the torque applying mechanism, being operable to produce an indication when the preset amount of torque has been applied to the lug by the torque applying mechanism; and (e) a biasing mechanism mounted to the handle and extending along the longitudinal axis thereof and being operable to apply a desired preset level of biasing force to the preset torque indicating mechanism along the longitudinal axis of the handle, in response to the defining of the desired preset amount of torque by the torque calibrating mechanism, to thereby preset the amount of torque that can be applied to the lug by the torque applying mechanism before the indication is produced by the preset torque indicating mechanism.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figures 1, 3, 4, 5:
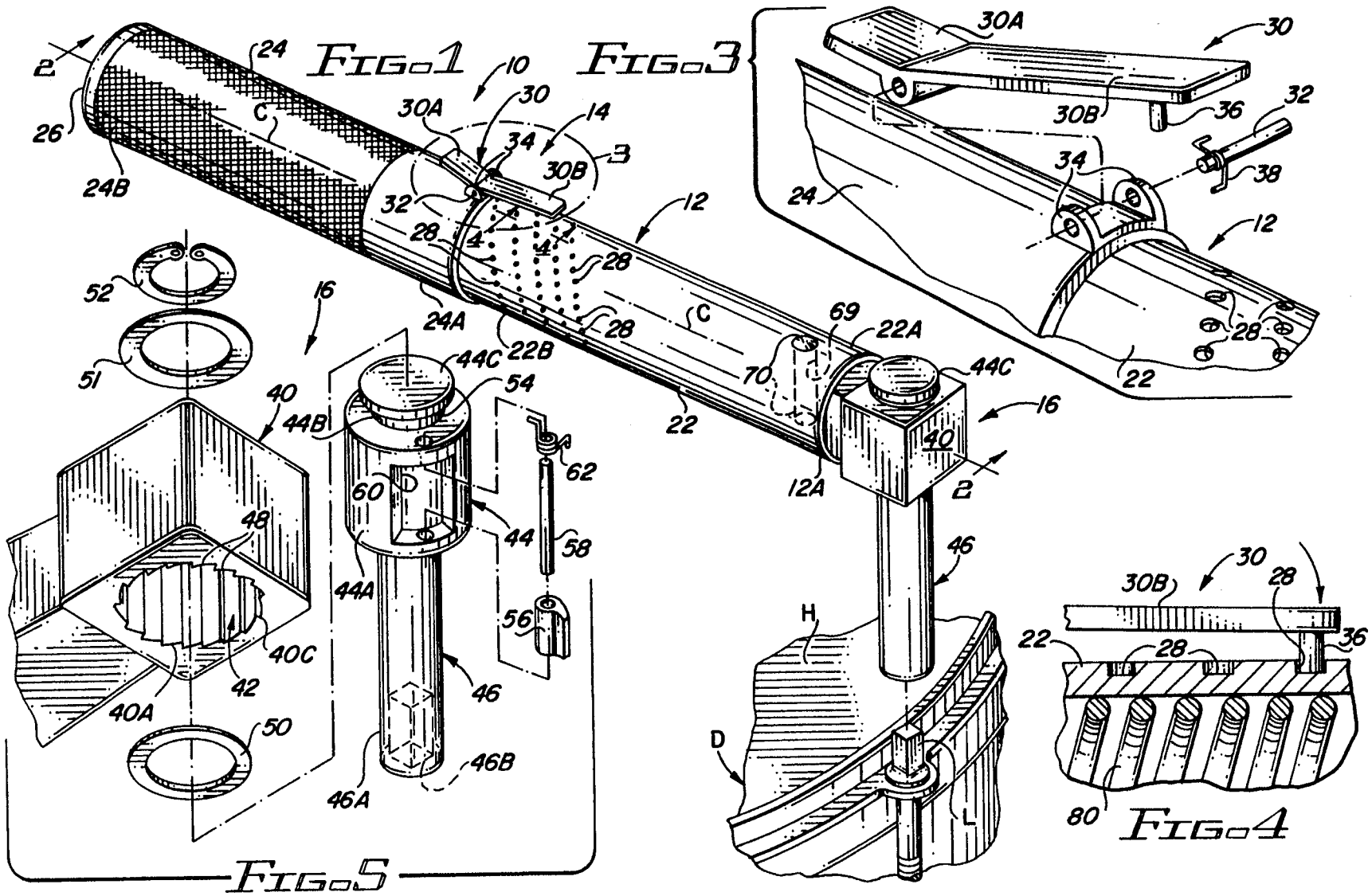
FIG. 1 is a perspective view of a precision tuning tool of the present invention being shown aligned with a standard tunable square lug of a tunable musical drum.
FIG. 3 is an enlarged detailed view of the portions of the precision tuning tool contained in the circle 3 of FIG. 1.
FIG. 4 is an enlarged detailed view of the portions of the precision tuning tool contained in the circle 4 of FIG. 2.
FIG. 5 is an enlarged exploded perspective view of the components of the precision tuning tool which coact to apply torque to the tunable lug on the drum when a bit end of the tool is engaged with the lug and the tool is pivoted relative thereto.
Figures 2, 6, 7, 8:
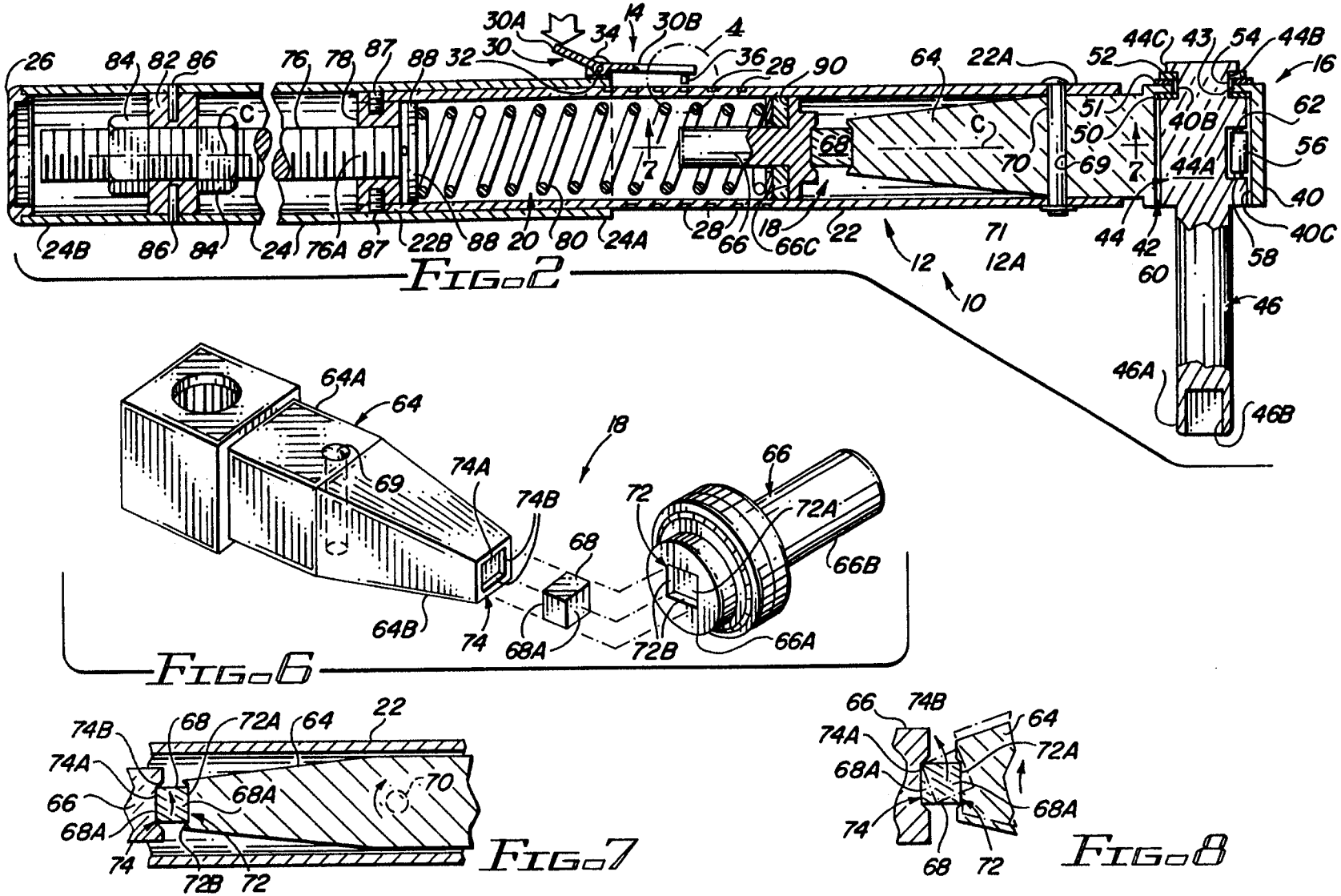
FIG. 2 is an enlarged axial sectional view of the precision tuning tool taken along line 2—2 of FIG. 1.
FIG. 6 is an enlarged exploded perspective view of the components of the precision tuning tool which coact to produce an audible sound indicating that a preset amount of torque has been applied to the tunable lug by the torque applying components of FIG. 5.
FIG. 7 is a fragmentary axial sectional view of the tool taken along line 7—7 of FIG. 2, showing the audible sound producing components of the tool in a tilted position relative to a longitudinal axis of the tool.
FIG. 8 is an enlarged detailed view of the portions of the precision tuning tool contained in the circle 8 of FIG. 7.

Referring to the drawings, and particularly to FIGS. 1 and 2, there is illustrated a precision tuning tool, generally designated 10, constructed in accordance with the principles of the present invention. Although other applications of the tool are possible, the tool 10 is specifically adapted for use in tuning each of a plurality conventional, or standard, tunable square lugs L rotatably mounted on a head H of a musical drum D (only one lug L being shown in FIG. 1).

Basically, the precision tuning tool 10 includes an elongated tubular handle 12, a torque calibrating mechanism 14, a torque applying mechanism 16, a preset torque indicating mechanism 18, and a biasing mechanism 20. The torque calibrating mechanism 14 and the preset torque indicating mechanism 18 respectively are mounted to the tubular handle 12 of the tool 10. The torque applying mechanism 16 is mounted to and supported by the preset torque indicating mechanism 18 of the tool 10 adjacent to one end 12A of the tubular handle 12. The torque applying mechanism 16 is engageable with the tunable lug L for applying torque to the lug L so as to tune the lug L by pivoting the tubular handle 12 of the tool 10 relative thereto. The torque calibrating mechanism 14 is operable to define a desired preset amount of torque to be applied to the lug L by the torque applying mechanism 16. The preset torque indicating mechanism 18 is operable, in response to application of torque to the lug L by the torque applying mechanism 16, to produce an indication, such as in the form of an audible clicking signal, when the desired preset amount of torque has been applied to the lug L by the torque applying mechanism 16. The biasing mechanism 20 is mounted both to the tubular handle 12 and to the torque calibrating mechanism 14 of the tool 10. The biasing mechanism 20 is operable to apply a desired level of biasing force to the preset torque indicating mechanism 18, in response to the defining of the particular desired preset amount of torque by the torque calibrating mechanism 14, to thereby preset the amount of torque that can be applied to the lug L before the indication is produced by the preset torque indicating mechanism 18.

Referring to FIGS. 1–4, the elongated tubular handle 12 of the precision tuning tool 10 has a central longitudinal axis C and includes a front tubular shaft 22 and a rear tubular shaft 24. The front tubular shaft 22 has a front end 22A defining the one end 12A of the tubular handle 12. The rear tubular shaft 24 has a front end 24A telescopicably and slidably fitted over a rear end 22B of the front tubular shaft 22 such that the front and rear tubular shafts 22, 24 extend coaxially along the central longitudinal axis C of the handle 12. The front and rear tubular shafts 22, 24 are movable both axially and circumferentially relative to one another along and about the central longitudinal axis C. The rear tubular shaft 24 is open at its rear end 24B, has a knurled external surface, and receives an end cap 26 in a frictional fitting relationship to removably close the same.

Referring still to FIGS. 1–4, the torque calibrating mechanism 14 of the precision tuning tool 10 includes a plurality of calibrated settings 28 in the form of small shallow notches 28 defined on the front tubular shaft 22 adjacent to the rear end 22B thereof, and a latching device 30 pivotally mounted by a pin 32 extending between a pair of laterally spaced tabs 34 attached on the front end 24A of the rear tubular shaft 24 of the tubular handle 12. The latching device 30 includes a rear portion 30A located rearwardly of the pivot pin 32 and a front portion 30B located forwardly of the pivot pin 32. The front portion 30B extends over the rear end of the front tubular shaft 22 of the handle 12 and has a latch element 36 depending from an outer end of the front portion 30B so as to overlie the settings 28. A coil spring 38 extends about one end of the pivot pin 32 and engages the latching device 30 and one of the tabs 34 so as to bias the latching device 30 for clockwise rotation, as viewed in FIGS. 1–3, and thus bias the front portion 30B thereof downwardly toward the settings 28 such that normally the latch element 36 is releasably engaged and fitted within a selected one of the plurality of calibrated settings 28 and thereby presets a desired amount of torque to be applied to the lug L by the torque applying mechanism 16.

By manually depressing the rear portion 30A of the latching device 30 so as to overcome the bias of the spring 38 imposed thereon, the front portion 30B and latch element 36 thereon are lifted away from the settings 28 so that the rear tubular shaft 24 of the handle 12 can be rotated and axially moved relative to the front tubular shaft 22 about and along the central longitudinal axis C of the handle 12 to select a different one of the settings 28 in which to engage the latch element 36. Preferably, the plurality of settings 28 are defined about the rear end 22B of the front tubular shaft 22 of the handle 12 in a spiral or helical path so as to conform to the axial and circumferential movement of the rear tubular shaft 24 relative to the front tubular shaft 22 required to adjust the amount of torque applied to the lug L. In such manner, the placement of the latch element 36 can be changed from one setting 28 to a successive one to change the preset amount of torque in small precise increments.

Referring to FIGS. 1, 2 and 5, the torque applying mechanism 16 of the precision tuning tool 10 includes a housing 40 rigidly attached to the preset torque indicating mechanism 18 adjacent to the front end 22A of the front tubular shaft 22 of the handle 12 and having a central bore 42, a cylindrical body 44 has a main body portion 44A disposed and rotatably mounted in the central bore 42 of the housing 40, and an extension 46 attached to the body 44 and having a working bit end 46A defined thereon. The housing 40 of the torque applying mechanims 16 has an interior cylindrical wall 40A open at the bottom of the housing and defining the central bore 42 with an endless series of axially parallel and circumferentially spaced one-way teeth 48 defined on the interior wall 40A. The housing 40 also includes an upper annular flange 43 at the top thereof defining a top opening 40B of smaller diameter than the bottom open 40C of the housing 40.

The main body portion 44A of the cylindrical body 44 of the torque applying mechanism 16 is disposed within the central bore 44 of the housing 40. The cylindrical body 44 also has an upper neck portion 44B of a reduced diameter size and an upper head portion 44C of an intermediate diameter size greater than the reduced diameter size of the upper neck portion 44B but less than the diameter size of the main body portion 44A. Also, the diameter size of the main body portion 44A is less than the diameter size of the bottom opening 40C of the housing 40 and the reduced and intermediate diameter sizes of the upper neck and head portions 44B, 44C are less than the diameter size of the top opening 40B of the housing 40 so as to allow the cylindrical body 44 to be installed into the housing 40 through the bottom opening 40C thereof and the upper neck and head portions 44B, 44C to be extended through the top opening 40B thereof. A pair of internal and external washers 50, 51 are disposed on opposite interior and exterior sides of the upper annular flange 43 of the housing 40 and a C-shaped ring 52 is seated above the external washer 51 and in a groove 54 defined in upper neck portion 44B of the cylindrical body 44 so as to support and rotatably mount the cylindrical body 44 to the housing 40 about the upper annular flange 43 thereof.

The torque applying mechanism 16 also includes a pawl 56 pivotally mounted by a pin 58 within a window 60 formed in a side of the cylindrical body 44. The pawl 56 is biased by a coil spring 62 to pivot outwardly into engagement with the series of one-way teeth 48 in the central bore of the houing 40 so as to allow the cylindrical body 44 to be rotated in only one direction by pivoting of the handle 12. When the handle 12 is pivoted in the opposite direction, the pawl 56 will be pivoted inwardly against the bias of the coil spring 62 due to camming action by the teeth 48 against the pawl 56.

The extension 46 is attached to and extends axially outwardly from the cylindrical body 44. The extension 46 thus extends from the housing 40 through the bottom opening 40C thereof and in a transverse relation to the central longitudinal axis C of the elongated handle 12. The working bit end 46A of the extension 46, in the form of a socket 46B, is engageable with the tunable lug L on the drum D for turning and tuning the lug L with one-way directional pivoting of the handle 12 and thus rotation of the extension 46 relative to the lug L.

Referring to FIGS. 2 and 6–8, the preset torque indicating mechanism 18 includes a forward member 64, a rearward member 66 and a polygonal shaped tilt element 68. The forward member 64 of the preset torque indicating mechanism 18 extends through the front tubular shaft 22 along the central longitudinal axis C of the elongated handle 12 and protrudes from the front end 22A thereof. The housing 40 of the torque applying mechanism 16 is rigidly attached to and supported at a front end 64A of the forward member 66. The forward member 66 has an elongated hole 69 therethrough receiving a pin 70, being releasably retained by a C-ring 71 on its lower end, to pivotally mount the forward member 66 to front end 22A of the front tubular shaft 22 of the handle 12 with sufficient clearance therebetween so as to permit the forward member 66 to undergo limited pivotal movement transversely to the central longitudinal axis C of the handle 12. The rearward member 68 of the preset torque indicating mechanism 18 extends through the front tubular shaft 22 along the central longitudinal axis C of the elongated handle 12 rearwardly of and spaced from the forward member 64. The rearward member 68 is fitted within the front tubular shaft 22 of the handle 12 so as to be able to undergo reciprocal movement axially along the longitudinal axis of the handle 12.

The polygonal shaped tilt element 68 of the preset torque indicating mechanism 18 preferably has a rectangular shape and is disposed between the rear end 64B of the forward member 64 and a front end 66A of the rearward member 66. The rear end 64B of the forward member 64 and front end 66A of the rearward member 66 have respective seats 72, 74 recessed therein which each has a flat bottom wall 72A, 74A and a plurality of interconnected flared side walls 72B, 74B extending outwardly from the flat bottom walls 72A, 74A in inclined relationships. The recessed seats 72, 74 receive and seat opposite ends 68A of the polygonal shaped tilt element 68 so as define a movable coupling of the tilt element 68 with the rear end 64B of the forward member 64 and the front end 66A of the rearward member 66. This movable coupling allows the tilt element 68 to be tiltable or tippable relative to the rear end 64B of the forward member 64 and the front end 66A of the rearward member 66 so as to permit or accommodate limited pivoting of the forward member 64 about the pin 70 relative to the rearward member 66 and relative to the front tubular shaft 22 and in transverse relation to the central longitudinal axis C of the handle 12 when the torque being applied to the lug L by the torque applying mechanism 16 reaches the preset amount of torque. The tilting movement of the tilt element 68 relative to the seats 72, 74 of the forward and rearward members 64, 66 in response to pivoting of the forward member 64 results in the alternate release and impact of the opposite flat ends 68A of the tilt element 68 from and with the flat bottom walls 72A, 74B of the seats 72, 74 which produces an audible clicking sound, signaling or indicating to the user that the preset amount of torque has been applied to the lug L.

Referring to FIG. 2, the biasing mechanism 20 of the precision tuning tool 10 includes an elongated externally threaded rod 76, a forward internally threaded annular collar 78, an elongated compressible coil spring 80, a rear annular bushing 82 and a pair of lock nuts 84. The externally threaded rod 76 of the biasing mechanims 20 is adjustably mounted in the rear tubular shaft 24 by the rear annular bushing 82 and the lock nuts 84 to place the rod 76 in a stationary axial position in the rear tubular shaft 24 extending along the central longitudinal axis C of the handle 12. The rear annular bushing 82 which receives the shaft 76 therethrough is fixed in the rear tubular shaft 24 of the elongated handle 12 by a pair of pins 86. The lock nuts 84 are threaded over the externally threaded rod 76 and disposed adjacent to opposite sides of the rear annular bushing 82 such that when tightened against the rear annular bushing 82 the lock nuts 84 retain the rod 76 at the desired stationary axial position along the central longitudinal axis C of the handle 12. The internally threaded annular collar 78 of the biasing mechanism 20 is stationarily mounted in the rear end 22B of the front tubular shaft 22 by screws 87 and threadably receives therethrough the forward end portion 76A of the externally threaded rod 76. The compressible coil spring 80 of the biasing mechanism 20 is disposed in the front tubular shaft 22 and extending along the central longitudinal axis C of the handle 12 between the forward end portion 76A of the externally threaded rod 76 and the rear end 66B of the rearward member 66 of the preset torque indicating mechanism 18. The coil spring 80 is captured between a flat disc 88 engaged with the forward end portion 76A of the externally threaded rod 76 and an annular bearing 90 fitted within the front annular shaft 22 against a rear facing annular shoulder 66C on the rearward member 66. The annular bearing 90 facilitates rotating of the coil spring 80 relative to the rearward member 66 with rotation of the rear tubular shaft 24 to adjust the degree of compression of the coil spring 80 and the amount of biasing force imposed against the rearward member 66 of the preset torque indicating mechanism 18.

Thus, upon release of the latching device 30 and by manually rotating the rear tubular shaft 24 relative to the front tubular shaft 22 of the handle 12, the latch element 36 is brought into engagement within a desired selected one of the plurality of calibrated settings 28 on the front tubular shaft 22 and the rod 76 is threadably rotated relative to and through the annular collar 78 to cause compression of the coil spring 80 against the rear end 66B of the rearward member 66 so as to apply the desired preset level of biasing force to the polygonal shaped tilt element 68, as dictated by or corresponding to the selected one of the plurality of calibrated settings 28.

From the above description of the precision tuning tool 10 of the present invention, it should be easily understood and appreciated that the tool 10 permits all lugs L of the drum to be tuned with equal force. As a result, they will remain in tune for a much greater period of time. Furthermore, different precise levels of intonation, heretofore unattainable, are now easily selectable with the precision tuning tool 10 of the present invention.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A precision tuning tool for use in tuning a tunable lug rotatably mounted on a musical drum, said precision tuning tool comprising:

(a) an elongated handle having a central longitudinal axis and including a front tubular shaft and a rear tubular shaft, said rear tubular shaft having a front end telescopically fitted over a rear end of said front tubular shaft such that said front and rear tubular shafts extend coaxially along said longitudinal axis of said handle, said front and rear tubular shafts being movable both axially and circumferentially relative to one another along and about said longitudinal axis;

(b) a torque applying mechanism engagable with a tunable lug rotatably mounted on a drum, said torque applying mechanism being operable to apply torque to the lug so as to tune the lug by pivoting said elongated handle relative thereto;

(c) a torque calibrating mechanism mounted to said elongated handle and being operable to define a desired preset amount of torque to be applied to the lug by said torque applying mechanism, said torque calibrating mechanism including a plurality of calibrated settings defined on said front tubular shaft adjacent to said rear end thereof and a latching device pivotally mounted on said front end of said rear tubular shaft and having a latch element releasably engageable with a selected one of said plurality of calibrated settings on said front tubular shaft to preset said desired amount of torque to be applied to the lug by said torque applying mechanism;

(d) a preset torque indicating mechanism mounted to said front tubular shaft and supporting said torque applying mechanism adjacent to a front end of said front tubular shaft and, in response to application of torque to the lug by said torque applying mechanism, being operable to produce an indication when said preset amount of torque has been applied to the lug by said torque applying mechanism; and (e) a biasing mechanism mounted to said rear tubular shaft and being operable to apply a desired preset level of biasing force to said preset torque indicating means, in response to the defining of said desired preset amount of torque by rotating said rear tubular shaft and said latching device therewith about said longitudinal axis of said elongated handle to bring said latch element into engagement with said selected one of said plurality of calibrated settings on said front tubular shaft to thereby preset said desired amount of torque to be applied to the lug by said torque applying mechanism before said indication is produced by said preset torque indicating mechanism.

2. The tool of claim 1 wherein said preset torque indicating mechanism includes:

a forward member extending through said front tubular shaft along said longitudinal axis of said elongated handle and protruding from a front end thereof, said torque applying mechanism being supported by a front end of said forward member; and means for mounting said forward member to said front end of said front tubular shaft so as to undergo pivotal movement transversely to said longitudinal axis of said elongated handle.

3. The tool of claim 2 wherein said preset torque indicating mechanism also includes:

a rearward member extending through said front tubular shaft along said longitudinal axis of said elongated handle rearwardly of and spaced from said forward member, said rearward member being fitted within said handle so as to be able to undergo reciprocal movement axially along said longitudinal axis of said elongated handle; and a polygonal shaped tilt element disposed between and movably coupled to a rear end of said forward member and a front end of said rearward member, said tilt element being tiltable relative to said rear end of said forward member and said front end of said rearward member so as to permit said forward member to pivot transversely relative to said longitudinal axis of said elongated handle and said rearward member when said torque being applied to the lug by said torque applying mechanism reaches said preset amount of torque and to produce an audible sound in response to said pivoting of said forward member.

4. The tool of claim 3 wherein said biasing mechanism includes:

an elongated externally threaded rod stationarily mounted in said rear tubular shaft and extending axially therethrough along said longitudinal axis of said elongated handle;

an internally threaded annular member stationarily mounted in said rear end of said front tubular shaft and threadably receiving said elongated externally threaded rod therethrough; and an elongated compressible coil spring disposed in said front tubular shaft and extending along said longitudinal axis of said elongated handle between a front end of said externally threaded rod and a rear end of said rearward member of said preset torque indicating mechanism such that upon manually rotating said rear tubular shaft relative to said front tubular shaft to bring said latch element into engagement with said selected one of said plurality of calibrated settings on said front tubular shaft, said externally threaded rod threads through said internally threaded annular member to cause compression of said coil spring against said rear end of said rearward member of said preset torque indicating mechanism so as to apply said desired preset level of biasing force to said polygonal shaped tilt element of said preset torque indicating mehanism corresponding to said selected one of said plurality of calibrated settings.

5. The tool of claim 1 wherein said torque applying mechanism includes:

a housing attached on said preset torque indicating mechanism adjacent to said front end of said front tubular shaft of said elongated handle, said annular housing including an interior cylindrical wall defining a central bore and having an endless series of spaced one-way teeth defined on said interior wall;

a cylindrical body rotatably mounted in said central bore of said housing and including a reciprocal pawl biased into engagement with said series of one-way teeth so as to only allow rotation of body in one direction; and an extension attached to and extending axially from said body in transverse relation to said longitudinal axis of said elongated handle, said extension having a working bit end non-rotatably engageable with the tunable lug on the drum.

6. The tool of claim 5 wherein said preset torque indicating mechanism includes:

a forward member extending through said elongated tubular handle and protruding from said one end portion of said elongated tubular handle, said housing of said torque applying mechanism being attached to said front end of said forward member; and means for mounting said forward member to said front end of said front tubular shaft so as to undergo pivotal movement transversely to said longitudinal axis of said elongated handle.

7. The tool of claim 6 wherein said preset torque indicating mechanism also includes:

a rearward member extending through said front tubular shaft along said longitudinal axis of said elongated handle rearwardly of and spaced from said forward member, said rearward member being fitted within said handle so as to be able to undergo reciprocal movement axially along said longitudinal axis of said elongated handle; and a polygonal shaped tilt element disposed between and movably coupled to a rear end of said forward member and a front end of said rearward member, said tilt element being tiltable relative to said rear end of said forward member and said front end of said rearward member so as to permit said forward member to pivot transversely relative to said longitudinal axis of said elongated handle and said rearward member when said torque being applied to the lug by said torque applying mechanism reaches said preset amount of torque and to produce an audible sound in response to said pivoting of said forward member.

8. The tool of claim 7 wherein said biasing mechanism includes:

an elongated externally threaded rod stationarily mounted in said rear tubular shaft and extending axially therethrough along said longitudinal axis of said elongated handle;

an internally threaded annular member stationarily mounted in said rear end of said front tubular shaft and threadably receiving said elongated externally threaded rod therethrough; and an elongated compressible coil spring disposed in said front tubular shaft and extending along said longitudinal axis of said elongated handle between a front end of said externally threaded rod and a rear end of said rearward member of said preset torque indicating mechanism such that upon manually rotating said rear tubular shaft relative to said front tubular shaft to bring said latch element into engagement with said selected one of said plurality of calibrated settings on said front tubular shaft, said externally threaded rod threads through said internally threaded annular member to cause compression of said coil spring against said rear end of said rearward member of said preset torque indicating mechanism so as to apply said desired preset level of biasing force to said polygonal shaped tilt element of said preset torque indicating mehanism corresponding to said selected one of said plurality of calibrated settings.

* * * * *